United States Patent [19]

Crawford

[11] Patent Number: 4,720,874

[45] Date of Patent: Jan. 26, 1988

[54] INTERLINING MATERIAL WITH SLITS FOR FACINGS

[75] Inventor: Warren N. Crawford, Lincolnwood, Ill.

[73] Assignee: Quick Service Textiles, Inc., Chicago, Ill.

[21] Appl. No.: 758,206

[22] Filed: Jul. 23, 1985

[51] Int. Cl.[4] ..... A41F 9/02

[52] U.S. Cl. ..... 2/221; 2/237; 2/244; 2/274

[58] Field of Search ..... 2/236, 237, 220, 221, 2/76, 274, 272, 244

[56] References Cited

U.S. PATENT DOCUMENTS

| | | | |
|---|---|---|---|
| 1,944,507 | 1/1934 | Grasso | 2/236 |
| 2,445,889 | 7/1948 | Rossi et al. | 2/338 |
| 3,063,058 | 11/1962 | Vollet | 2/338 |
| 3,735,424 | 5/1973 | Maggio et al. | 2/237 X |

FOREIGN PATENT DOCUMENTS

| | | | |
|---|---|---|---|
| 1143466 | 2/1969 | United Kingdom | 2/237 |

*Primary Examiner*—H. Hampton Hunter

*Attorney, Agent, or Firm*—Eugene F. Friedman

[57] ABSTRACT

An elongated interlining material for facings, for example waistbands, having slits on at least one and possibly both of its elongated edges. The slits permit the sewing of the facing to a curved edge of a garment in the normal fashion. In particular, the material will follow curves in the garment without utilizing any special guides, sewing techniques, or equipment. The facing incorporates the interlining, at least partially enclosed in a stretchable, elongated fabric, or outerlining. The facing, in turn, is sewn to the garment's edge, with the exposed surface of the interlining, if any, adjacent to the garment. The slits, directed away from the edge of the garment, permit the interlining to adapt to a concave curve by opening and allowing the portions of material on either side of the slit to slightly separate from each other. Around a convex curve, portions of interlining material adjacent to a slit may overlap.

17 Claims, 6 Drawing Figures

FIG. 1
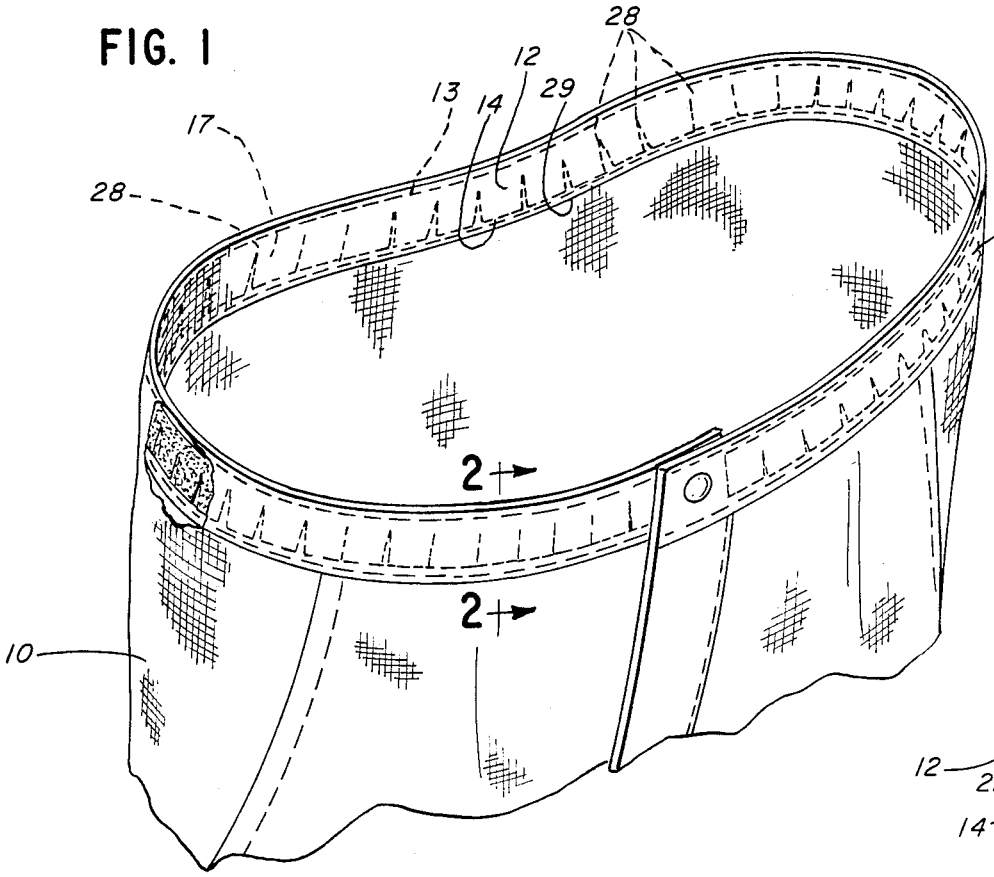
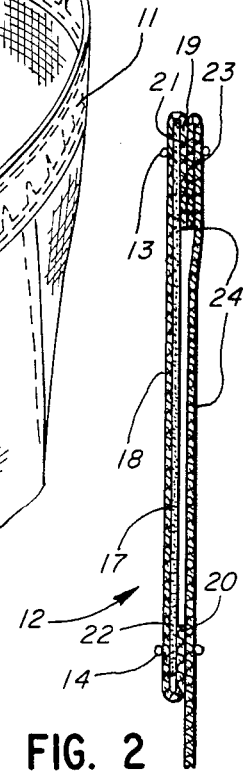
FIG. 2
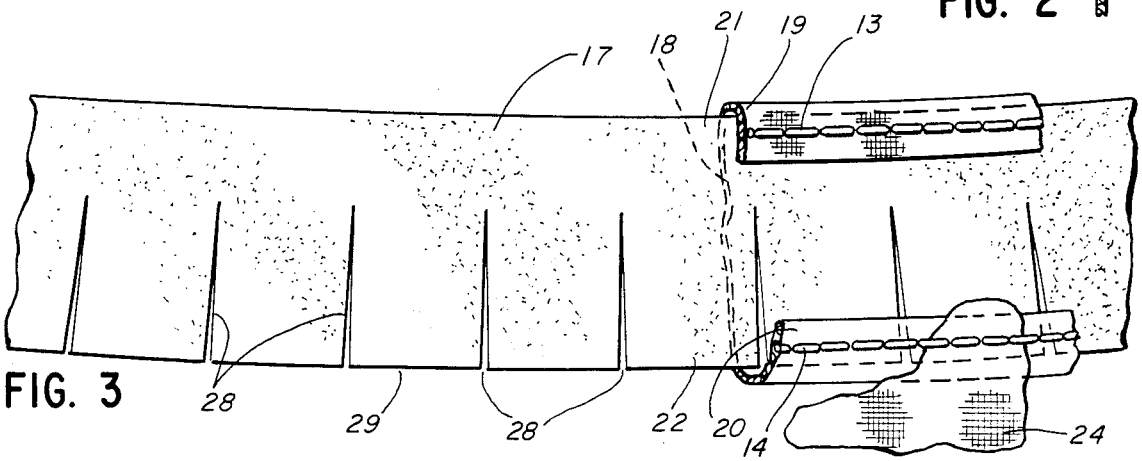
FIG. 3
FIG. 4
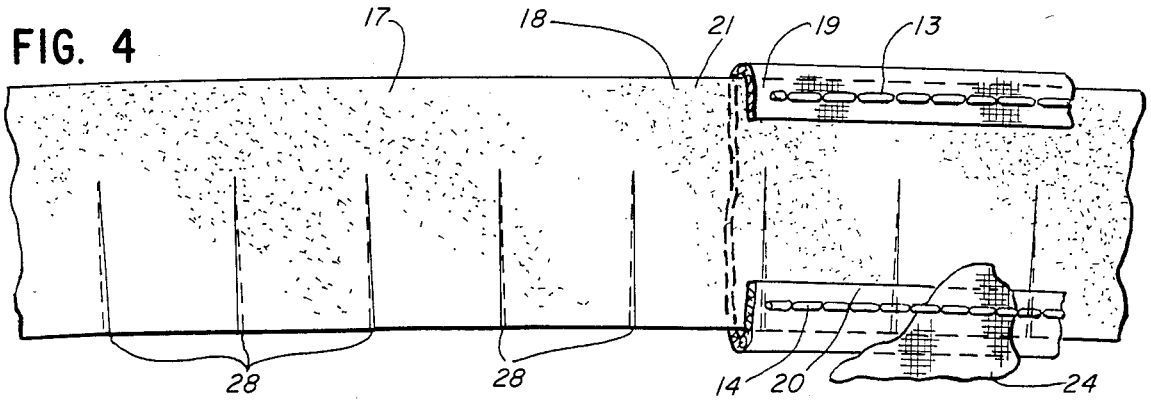

FIG. 5
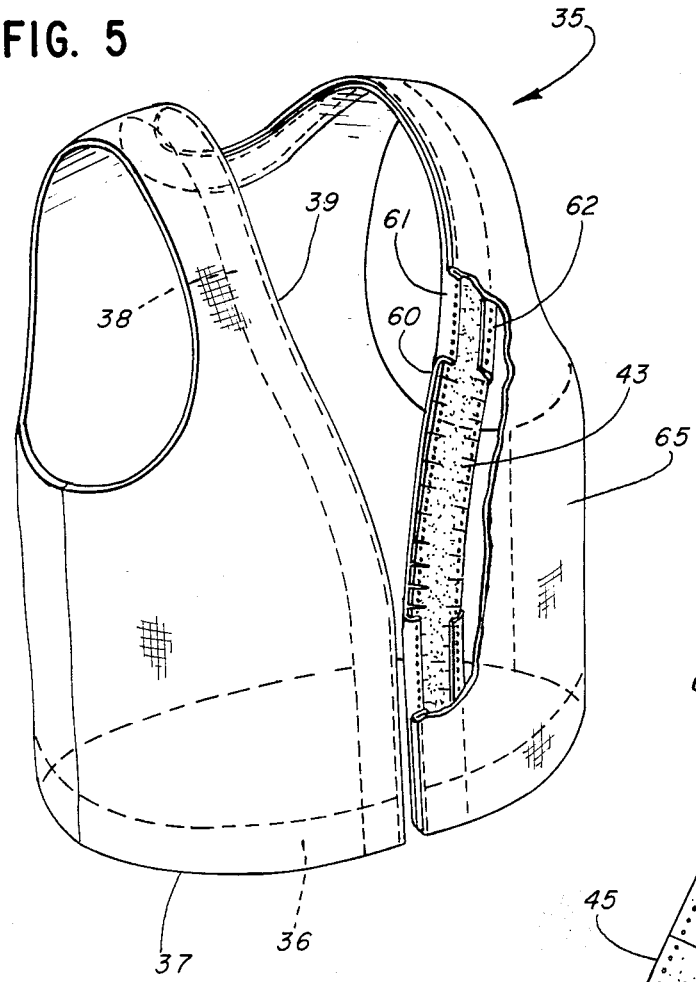
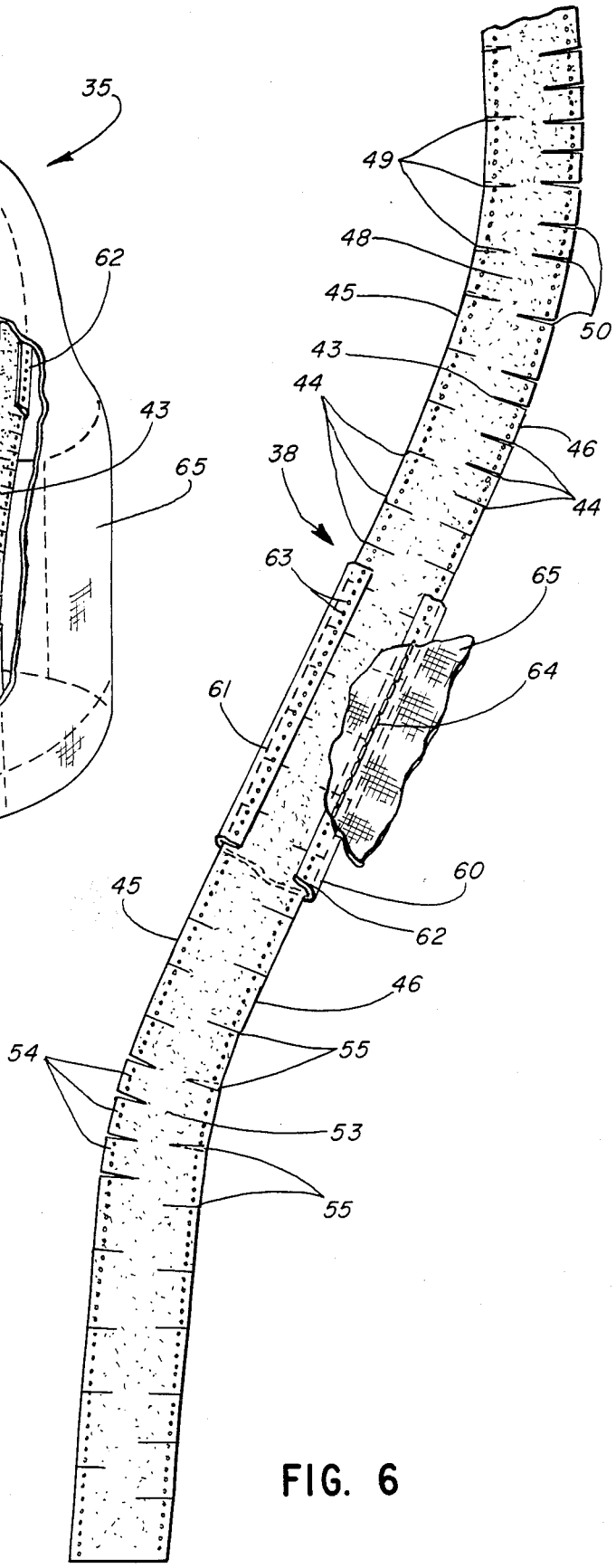
FIG. 6

INTERLINING MATERIAL WITH SLITS FOR FACINGS

BACKGROUND

Most slacks, pants, have a waistband which imparts some rigidity and, thus, neatness to the upper edge of these garments. Yet, notwithstanding the efforts of manufacturers, most stacks display some puckering in the rear slightly below the area of the attachment of the waistband.

Naturally, slacks manufacturers seek to make their clothes more attractive. Thus, they have recently attempted to place curves into the waist to avoid the puckering of the rear and to give a more generally pleasing appearance. The curves on the slacks' waist permit it to conform to the shape of the individual. Especially does this have pertinence for a woman who possesses a significant curvature in the region of her hips.

These problems become exacerbated in the construction of fashion jeans. Typically, most jeans do not have any facing, or waistband, whatsoever. However, the higher fashion versions may wish to incorporate a facing to avoid the rolling and crumpling of the waist on garments without such bands. However, the fashion jeans may also include a curving of the waistline to more closely adhere to a person's natural waist. Attaching a waistband to such a curving waist incurs the problems discussed above.

Moreover, jeans generally sell at a lower price than dress slacks. Thus, the manufacturer has less funds with which to finish his product. Accordingly, the extra expense of placing a waistband on a curving waist of a pair of jeans may well prove less acceptable to the manufacturer than for dress slacks.

Other items of clothing may have facings similar to waistbands to provide a more pleasing edge. However, placing such facings on items like vests with curving lines incurs the same problems discussed above for slacks. These articles of clothing have such curved edges that the attachment of a facing would prove significantly expensive if even possible.

Accordingly, the search continues for a waistband or facing that can facilely follow a curved edge of a garment. Furthermore, the usual sewing equipment should desirably have the capability of attaching the facing or waistband.

SUMMARY

The use of an interlining material, elongated in form, having slits extending from one of the longer edges toward the other will allow its facile attachment to the curving edge of a garment. The slits in the interlining have spaces between them and, naturally, end before reaching the other edge.

In the region of a concave edge on a garment, the material on the sides of a slit will separate from each other to permit the interlining to form a similar curve. Conversely, for a convex curve, the material on either side of the slit will overlap to correctly follow the garment's contour.

As a modification, the elongated interlining material may have slits on both sides. This would provide it with greater flexibility when needed by particular types of garments. Thus, in going around a curve, the slits on one side would open while the material on the other side would overlap at the slits.

The facing, naturally, would include first the elongated strip of interlining material having first and second long edges. The slits would extend from one of the long edges to the other. A second material, or interlining, for the facing typically has a stretchable elongated fabric with third and fourth long edges. This fabric will partially envelop the interlining and thus must have a greater width. The outerlining has its two long edges generally parallel to and folded over the two long edges of the interlining.

Attaching the facing to a garment involves placing the former along an edge of the latter. The actual affixation involves sewing one edge of the interlining with the folded over edge of the outerlining to the shell fabric in the vicinity of the garment's edge. A second line of stitches passes through the other edge of the interlining with its folded over edge of the outerlining. This row of stitches then affixes the outer edge to the shell at a location further removed from the shell's edge.

The outerlining should have stretchable characteristics. Thus, in following a curve, the slits in the interlining allow that material to easily adjust its shape to match that of the garment. The stretchable nature of the outerlining similarly allows it to accommodate itself to the garment's contours.

The capability of the facing to follow a garment's shape permits its attachment with the normal, straight sewing machine. Thus, the interlining with slits permits the inexpensive and easy attachment, without special equipment, of a facing to an edge of a garment having contours.

BRIEF DESCRIPTION OF THE FIGURES

FIG. 1 shows the upper portion of a pair of slacks incorporating a facing having an interlining with slits at spaced intervals.

FIG. 2 gives a cross-sectional view along the line 2—2 of the slacks with facing and slit interlining of FIG. 1.

FIG. 3 shows a facing utilizing an interlining with slits on one side in a region of a concave curve in a garment.

FIG. 4 displays an interlining and facing similar to FIG. 3 in the region of a convex curve of the garment to which attached.

FIG. 5 shows a vest, partly cut away, depicting a facing utilizing a strip of interlining material having slits on both sides.

FIG. 6 gives the interlining material for the vest of FIG. 5 with the outerlining and shell materials mostly removed.

DETAILED DESCRIPTION

FIG. 1 shows the pair of slacks 10 with the waist 11. The waistband 12 fits on the inside of the slacks' waist 11 where the two rows of stitches 13 and 14 hold it in place.

More specifically, as seen in FIG. 2, the waistband 12 includes first the interlining material 17 which serves to provide body to the garment's waist. The outerlining 18 covers the interlining 17. The outerlining's edges 19 and 20 fold over the edges 21 and 22, respectively, of the interlining.

The row of stitching 13 then passes through, starting at the inside of the garment 10, the outerlining 18, the edge 21 of the interlining 17, the folded over edge 19 of the outerlining 18, the folded over edge 23 of the shell material, and then the shell material 24 itself. The lower stitching 14 passes through similar layers of material except that it does not have a folded over edge of the shell 24. Thus, the stitching 14 goes through the outerlining 18, the edge 22 of the interlining 17, the folded over edge 20 of the outerlining 18, and then the body of the shell 24.

As seen in FIG. 1, the interlining 17 has the slits 28 cut into it. In the region of a concave curve in the material, such as in the middle of the back 29 in FIG. 1, the slits open and the material on either side separates. This appears more clearly in FIG. 3. The opening of the slits 28 allows the interlining material 17 to follow the curve of the garment 10 when it experiences a concave curve. The ability of the interlining to follow the curve permits the use of the usual straight sewing machine without costly equipment or modification.

FIG. 4 shows the configuration of the interlining 17 around the slits 28 when attached to a convex curve of a garment. As seen there, the material on either side of the slits 28 overlap to a small extent so that the interlining 17 may have a similar convex curve.

The slits 28 in FIGS. 1 to 4 extend over half of the width of the interlining 17. Although not essential, this does assure that the interlining 17 will have the flexibility to follow the curve of the garment 10. Further, a substantially equal distance separates the slits 28 from each other. Again, this does not represent an essential feature, but does provide for ease in manufacture The outerlining material 18 in FIGS. 1 to 4 should have some degree of stretchability. This will allow it to adapt to the curve of the edge 11 of the slacks 10. Utilizing a woven fabric cut on the bias will provide this minimal, required stretching to the outerlining 18.

The vest seen generally at 35 in FIG. 5 includes first th lower facing 36 along its bottom edge 37 and the upper facing 38 along the front edge 39. The upper facing 38 appears more clearly in FIG. 6. As seen there, the facing 38 includes the interlining 43 which, in comparison to that shown in FIGS. 1 to 4, includes the slits 44 along both of its elongated edges 45 and 46.

The slits on both sides 45 and 46 permit the interlining 43 to bend easily in either direction. As seen in FIG. 5, the facing 38 starting from the waist bends both ways in going up and around an individual's neck and back down to the waist. The slits 44 on both of the sides 45 and 46 allow the attachment of the facing 38 by the usual straight sewing machine.

In particular, the interlining 43 experiences a concave curve in the upper region 48. There the slits 49 on the outer edge 45 may tend to overlap slightly while the slits 50 on the inner edge open. At the lower curving region 53, the opposite occurs; the slits 54 on the outer edge 45 open while the slits 55 on the inner edge experience overlap.

In a further comparison to the interlining 17 in FIGS. 1 to 4, the interlining 43 in FIGS. 5 and 6 has slits that do not extend over half of the width between the edges 45 and 46. Furthermore, the slits have different lengths, with those on the inner edge 46 generally longer than those of the ouer edge 45. Additionally, unequal spacings separate the slits 44 on both of the edges 45 and 46.

The outerlining 60 on the vest 35 covers the side of the facing near the wearer. The edges 61 and 62 of the outerlining fold over the edges 45 and 46, respectively, of the interlining 43 to envelop them. The rows of stitching 63 and 64, respectively, attach the edges 45 and 46 of the interlining 43 and the edges 61 and 62 of the outerlining 60 to the shell fabric 65.

Any usual interlining material will suffice for the strips 17 and 43 shown in the figures. Thus, it may display a stretchable or a substantially unstretchable character. Furthermore, it may have any of the usual compositions of interlining fabric including a nonwoven, polyester containing, thin piece of material.

Similarly, the outerlinings 18 and 60 may have any of the compositions generally seen in the industry. It may include even a shell or pocketing material, as well as the usual outerlinings generally used. It should, however, display some stretchable characteristics so that it may follow the curve of the garment to which it attaches.

Accordingly, what is claimed is:

1. A facing for a garment comprising:

(A) a first material comprising an elongated strip of stretchable fabric with first and second long edges having a set of slits therein spaced apart from each other, each of said slits in said set extending across part of the width of said strip from said first edge toward said second edge, each of said slits in said set ending prior to reaching said second edge; and (B) a second material comprising a stretchable, elongated fabric with third and fourth long edges and having a greater width than said first material, placed in contact with said first material with said third and fourth edges substantially parallel to and folded over said first and second edges, respectively.

2. The facing of claim 1 wherein said first and third edges lie substantially parallel to said second and fourth edges, respectively.

3. The facing of claim 2 wherein said slits extend from said first edge more than half of the width of said strip towards said second edge.

4. The facing of claim 3 wherein said second material comprises a woven fabric cut on the bias relative to said third and fourth edges.

5. The facing of claim 3 wherein a substantially uniform distance separates all adjacent slits in said first material and each of said slits extends about the same distance from said first edge towards said second edge.

6. The facing of claim 5 wherein said second material is composed of a shell, pocketing, or interlining cloth.

7. The facing of claim 5 wherein said set is a first set and said strip has a second set of slits therein spaced apart from each other, each of said slits in said second set extending across part of the width of said strip from said second edge toward said first edge, each of said slits extending in said second set ending prior to reaching said first edge.

8. A garment comprising:

(A) a shell having a first edge; and (B) a facing in contact with said shell and in proximity to said first edge and having:

(1) a first material comprising an elongated strip of fabric with second and third long edges having a set of slits therein spaced apart from each other, each of said slits in said set extending across part of the width of said strip from said second edge toward said third edge, each of said slits in said set ending prior to reaching said third edge; and (2) a second material comprising a stretchable elongated fabric with fourth and fifth long edges and having a greater width than said first material, placed in contact with said first material and said shell with said fourth and fifth edges substantially parallel to and folded over said second and third edges, respectively, said third and fifth edges being stitched to each other and to said shell in close proximity and parallel to said first edge and said second and fourth edges being parallel to said fifth edge but lying further from said first edge than said third and fifth edges.

9. The garment of claim 8 wherein said slits in said set extend from said second edge more than half of the width of said strip towards said third edge.

10. The garment of claim 9 wherein said second material comprises a woven fabric cut on the bias relative to said fourth and fifth edges.

11. The garment of claim 8 wherein a substantially uniform distance separates all adjacent slits in said strip and each of said slits extend about the same distance from said first edge towards said second edge.

12. The garment of claim 11 wherein said second material is composed of a shell, pocketing or interlining cloth.

13. The garment of claim 12 wherein said first material is substantially nonstretchable.

14. The garment of claim 13 wherein said set is a first set and said strip has a second set of slits therein spaced apart from each other, each of said slits in said second set extending across part of the width of said strip from said second edge toward said first edge, each of said slits extending in said second set ending prior to reaching said first edge.

15. The garment of claim 13 wherein said first material is a nonwoven, polyester containing, thin fabric.

16. The garment of claim 12 wherein said first material is stretchable.

17. The garment of claim 16 wherein said set is a first set and said strip has a second set of slits therein spaced apart from each other, each of said slits in said second set extending across part of the width of said strip from said second edge toward said first edge, each of said slits extending in said second set ending prior to reaching said first edge.

* * * * *